United States Patent [19]

Fast

[11] Patent Number: 4,773,172

[45] Date of Patent: Sep. 27, 1988

[54] MERCHANDISE INFORMATION TAG WITH ADAPTABLE MOUNTING PORTION

[76] Inventor: Jacob Fast, 7561 NW. 9th St., Plantation, Fla. 33317

[21] Appl. No.: 109,330

[22] Filed: Oct. 19, 1987

[51] Int. Cl.[4] ..... G09F 3/18

[52] U.S. Cl. ..... 40/657; 40/124.1; 40/662; 248/220.4; 248/221.4

[58] Field of Search ..... 40/19.5, 316, 308, 20 R, 40/124.1; 248/301, 308, 215, 340, 220.4, 220.2, 221.4, 221.3, 225.2, 227; 211/57.1, 59.1

[56] References Cited

U.S. PATENT DOCUMENTS

| | | | |
|---|---|---|---|
| 2,105,482 | 1/1938 | Johnson | 248/221.3 |
| 4,572,380 | 2/1986 | Langwell | 248/221.4 |
| 4,624,431 | 11/1986 | Pfeifer | 248/221.3 |
| 4,665,639 | 5/1987 | Fast | 40/19.5 |
| 4,693,441 | 9/1987 | Conway | 211/57.1 |
| 4,698,929 | 10/1987 | Fast | 40/19.5 |
| 4,925,944 | 7/1985 | Fast | 40/19.5 |

*Primary Examiner*—John J. Wilson
*Assistant Examiner*—Cary E. Stone
*Attorney, Agent, or Firm*—Holman & Stern

[57] ABSTRACT

A product information display tag structure for presenting product information at the distal end of an elongate product display hook having a proximal end bracket for attaching the hook to a horizontal elongate support bar. The tag has a proximal end mounting portion for securing same to the bar over the bracket and the mounting portion is adaptable to accommodate a variety of such brackets. The tag is made from die-cut plastic sheet material.

13 Claims, 3 Drawing Sheets

MERCHANDISE INFORMATION TAG WITH ADAPTABLE MOUNTING PORTION

BACKGROUND OF THE INVENTION

This invention relates to product identification and information tags for merchandise suspended from elongate horizontally orientated support hooks and the like. More particularly, the invention relates to such tags which may be readily attached to and removed from the support hooks without being subject to inadvertent removal, and which display product information forwardly of merchandise supported on a hook.

My prior U.S. Pat. No. 4,525,944 issued July 2, 1985 discloses, inter alia, elongate product information and identification tags made of plastic sheet which display the product information forwardly of items suspended from horizontal hooks which may extend, for example, from an apertured support boad or the like. The tags include a mounting portion for attachment to and removal from the hook at a location adjacent the board, an intermediate portion extending forwardly from the mounting portion along the length of the hook and the merchandise suspended therefrom, and a display portion integrally formed at the distal end of the intermediate portion and which is bent downwardly in front of the hook for the display of required product identification and/or information data. Further, the tags may have an aperture adjacent the distal end of the intermediate portion for an end portion of the hook to project upwardly through, thereby providing lateral stabilization of the tag. When a product is removed from the hook over the front end, the tag flexes upwardly to free the end of the hook, and the tag drops back over the end of the hook after the product has been removed.

Further, my co-pending patent application Ser. No. 719,116 filed Apr. 2, 1985, discloses a similar product information tag which has a removable and replaceable display portion at the forward end enabling the product labeling readily to be changed, if required.

The disclosures of both my patent and co-pending application noted above are expressly incorporated herein by reference.

The tags as disclosed in both the patent and the pending application are provided with mounting portions particularly adapted for use with horizontally oriented elongate support hooks, generally formed of metal rods, which fit into an apertured board. However, frequently in merchandising displays, the support hooks may be particularly adapted to attach to supports other than apertured boards. For example, there are in existence elongate product support hooks having mounting brackets at their proximal ends which are particularly adapted for attachment to a flat transversely extending bar. It is an object of the present invention to provide a merchandise information and display tag structure of the general type discussed above, but which has a mounting portion which is adaptable so that it can be used with any one of a variety of such flat bar-attached hooks.

SUMMARY OF THE INVENTION

Generally stated, the invention provides an elongate product information and display tag of the overall type discussed, preferably being die-cut or the like from sheet plastic of the kind commonly used for such tags and including a proximal end mounting portion for attaching the tag to any one of the variety of hooks discussed above, and an elongate intermediate portion extending from the mounting portion to extend over the hook and display product information at the distal end thereof. The mounting portion conveniently may be of rectangular form with a large size central rectangular cutout and a pair of lengthwise extending elongate cutouts disposed respectively on opposite sides of the central cutout. The mounting portion further includes transverse slits extending respectively from opposite longitudinal edges thereof into the elongate cutouts approximately midway along their length, so as to provide a pair of flaps or flexible fingers on each side of the mounting portion. Further, the mounting portion is separated from the intermediate portion by a central transverse bend line and further slits extending from opposite edges of the tag toward the bend line.

In use, the mounting portion is folded down from the intermediate portion substantially at right angles and opposite edge sections defining the aforementioned fingers are folded forwardly substantially at right angles to the central body of the mounting portion. For attaching the tag to a flat bar-supported elongate product display hook, the mounting portion is placed behind the bar so that rear portions of the hook bracket extend through the enlarged central cutout, and then the flexible fingers are manipulated over the front of the bar, top and bottom, so as to grip the bar on each side of the hook bracket.

The enlarged central cutout is sufficient to accommodate a variety of different design hook brackets and the mounting portion may also include a bottom flap for certain types of hook bracket which have a bottom flange projecting behind the bar.

Additional features and advantages of the invention will become apparent from the ensuing description and claims read in conjunction with the attached drawings.

DESCRIPTION OF THE PREFERRED EMBODIMENTS

Figures 1, 2, 3, 4:
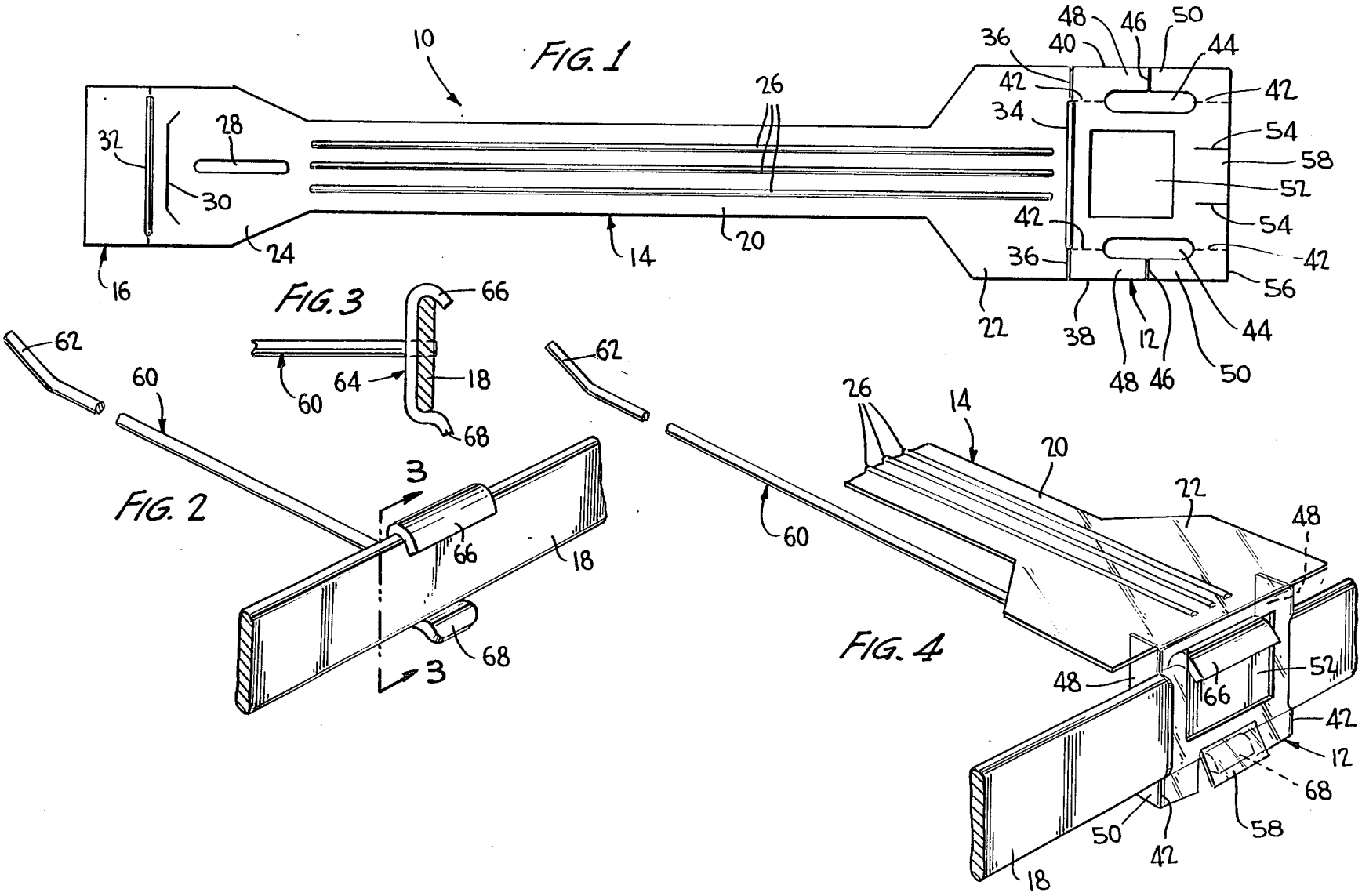
FIG. 1 is a plan view of a product information display tag structure in accordance with the invention.
FIG. 2 is a perspective view, from the back, of a first form of flat bar-supported product display hook with which the tag may be used.
FIG. 3 is a sectional view on line 3—3 or FIG. 2.
FIG. 4 is a view similar to FIG. 2 with the tag attached.
Figure 5:
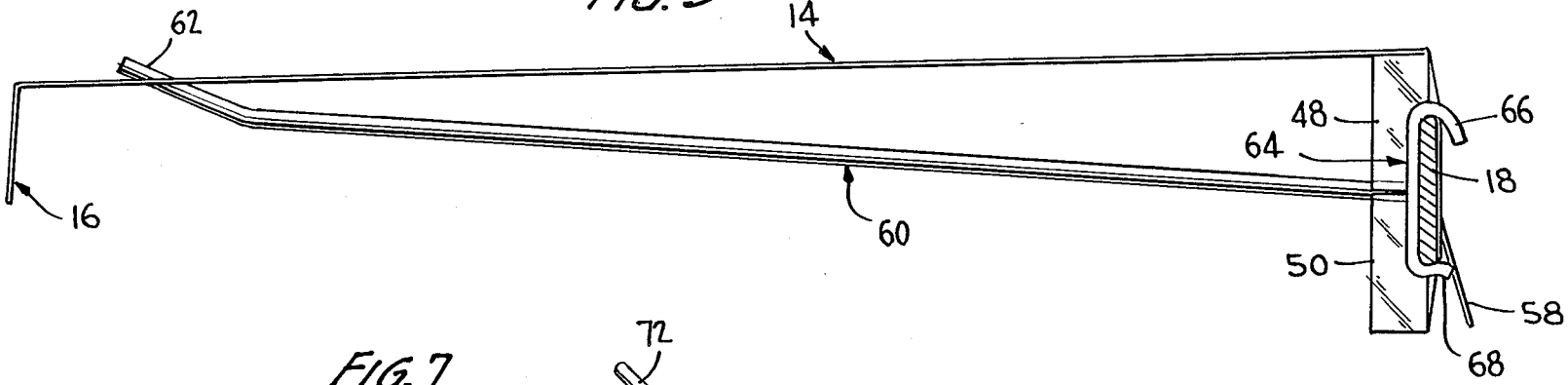
FIG. 5 is a side elevational view of the structure shown in FIG. 4.

FIG. 1 shows an elongate product identification and display tag 10 of the general type disclosed in the above noted patent and patent application, the tag being die cut in a plastic sheet material and including a proximal end mounting portion 12 an elongate intermediate portion 14, and a distal end information display portion 16. The tag is particularly adapted for use with a variety of elongate product display hooks, as shown in the subsequent figures, the hooks being of a type which attach to an elongate flat metal bar 18, as will be described. In use, the mounting portion 12 of tag 10 effectively secures the tag to the bar 18, the elongate intermediate portion extends over the length of the display hook, and the distal end portion 16 displays product information (relating to products which may be suspended from the hook) at the distal end of the hook.

Reverting to FIG. 1, it will be noted that intermediate portion 14 has a narrow elongate central section 20 and wider distal and proximal end sections 22 and 24 respectively. Further, the intermediate portion 14 is reinforced by longitudinally extending creases 26 or the like. This form of intermediate portion for a tag structure of the type under discussion is disclosed in detail in co-pending application Ser. No. 876,167, filed June 19, 1986 the contents which is also expressly incorporated herein by reference. As noted in this patent application the narrowing and reinforcing of the central section 20 reduces the amount of material required in this section of the tag while the creases reinforce the tag against transverse flexure. Also, by reducing the tag width, a smaller area is available for dust collection.

The distal end section 24 of the tag is provided with an elongate slot 28 for the forward end of a display hook to project upwardly through in known manner. Also, this section of the tag may be provided with a transverse slit 30 for attachment of a separate display element in the manner disclosed in the above noted co-pending patent application Ser. No. 719,116, filed Apr. 12, 1985. In this regard, while the tag 10 as illustrated has in integral display portion 16, in alternative constructions according to the invention, section 16 may be eliminated if the tag is to be used with a separate display element and conversely, if section 16 is present, the transverse attachment slit 30 could be eliminated. In the illustrated structure, display portion 16 is connected to the intermediate portion 14 by a transverse bend line 32.

The mounting portion 12 of the tag is connected to proximal section 22 by a central transverse bend line 34 and transverse slits 36 which extend from opposite longitudinal edges 38 and 40 of the tag up to the opposite edges of the bend line 36. Extending from the respective junctions of bend line 34 and slits 36 are longitudinally extending bend lines 42 and these longitudinal bend lines 42 are interrupted by respective relatively narrow elongate cutouts 44. Extending into the cutouts 44 from the opposite longitudinal edges 38 and 40 of the blank are respective transverse slits 46.

The above described structure of the mounting portion 12 allows the mounting portion as a whole to be folded down at a right angle with respect to portion 14 of the tag about the bend line 34 and further allows outer sections of the mounting portion to be folded inwardly at right angles about the bend lines 42. Due to the provision of the cutouts 44 and the slits 46, these outer sections of the mounting portion provide respective upper flaps or fingers 48 and lower flaps or fingers 50 which, in use, can be flexed around the flat bar 18 from behind, in order to attach the tag to the bar as seen, for example in FIGS. 4, 5, 8, 11 and 12, which latter figure shows the manner in which the lower fingers 50 are flexed around the bar. In this connection it will be evident that the outline of the respective cutouts 44 effectively conforms with the outline of bar 18.

Mounting portion 12 further includes a large rectangular central cutout 52 and longitudinal slits 54 extending from a proximal edge 56 of the tag, the slits 54 defining a central flap 58.

As indicated above, the tag 10 is specifically adapted for use with a variety of product display hooks which may be attached to the support bar 18. In this regard, FIGS. 2 through 5 show a first form of such elongate hook 60 which has an up-turned distal end 62 to fit through slot 28 of the tag as previously referred to and a metal mounting bracket 64 to which the proximal end of the hook 60 is attached by welding or the like. The mounting bracket 64 is bent to provide an upper securing prong 66 and a lower narrower securing prong 68 whereby the hook may be snap fitted onto the bar 18 and retained thereon by friction as shown for example in FIGS. 2 and 3.

In attaching the tag 10 to the bar-hook combination shown in FIGS. 2 and 3, mounting portion 12 of the tag is folded down about bend line 34 and the transverse outer edges of the tag defining the fingers 48 and 50 are folded inwardly at right angles. The mounting portion is located behind the bar 18 so that the central cutout 52 embraces the upper prong 66 of the hook, the cutout being sized to accommodate this prong. Then, the fingers 48 and 50 are flexed around the bar 18 from behind respectively above and below the bar to bring the tag into gripping engagement around the bar. It will be noted that in the attached position of the tag shown in FIG. 4, the flap 58 is flexed somewhat outwardly by the lower prong 68 of the hook. It will evident that the disclosed structure provides a simple and effective way in which the tag may be attached to the bar-hook combination.

Figure 8:
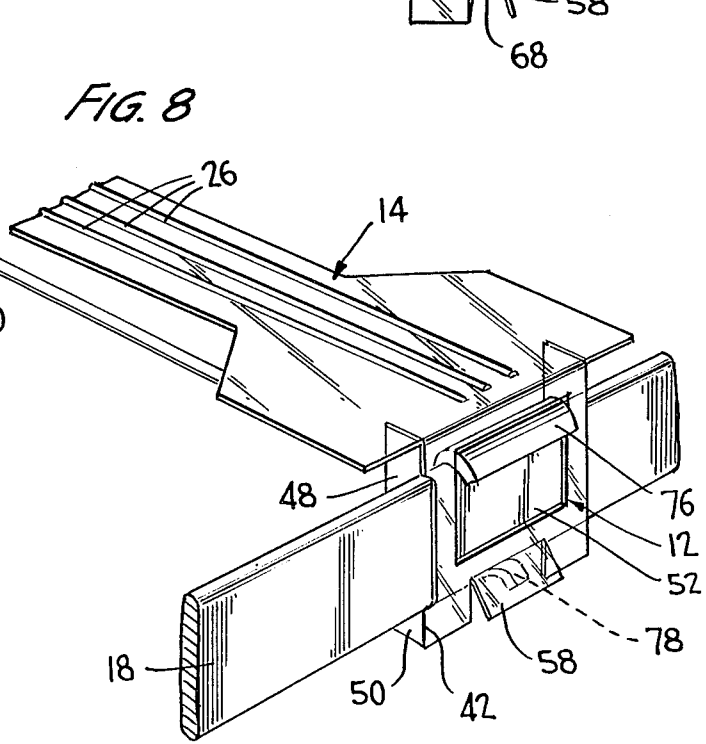
FIG. 8 is a view similar to FIG. 4 showing the second form of hook.
Figure 7:
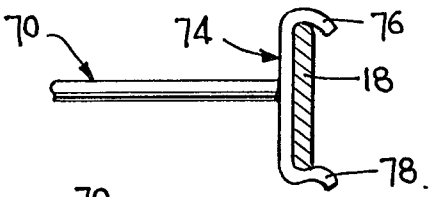
FIG. 7 is a view similar to FIG. 3 showing the second form of hook.
Figure 6:
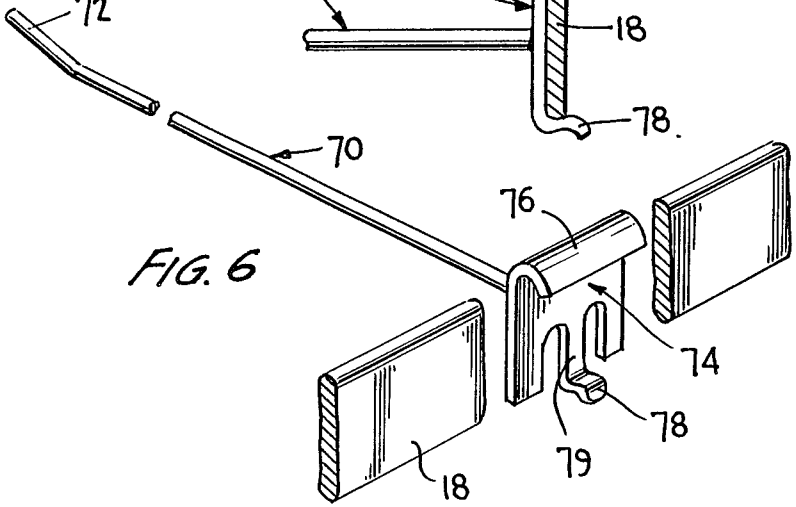
FIG. 6 is a view similar to FIG. 2 but showing a second form of flat bar-supported product display hook with which the tag can be used.

FIGS. 6 to 8 show a second form of product display hook 70 which also has an upwardly bent distal portion 72 as in the previously described hook and a different form of metal bracket 74 at its proximal end for attaching the hook to bar 18 In this case, metal bracket 74 again has an upper prong 76 extending substantially the entire width of bracket 74 and a lower prong 78 formed on a central finger 79 of the bracket. It will be evident that tag 10 may be attached to the bar-hook combination shown in FIGS. 6 and 7 in similar manner to the previously described embodiment with the cutout 52 in this case embracing prong 76 of the hook and the flap 58 again being flexed somewhat outwardly by prong 78. It will be self-evident that where the alternative hook bracket structures such as brackets 64 and 74 are of respectively somewhat different width, the central cutout 52 of the tag will be sized to accommodate the larger of these.

Figures 9, 10, 11, 12:
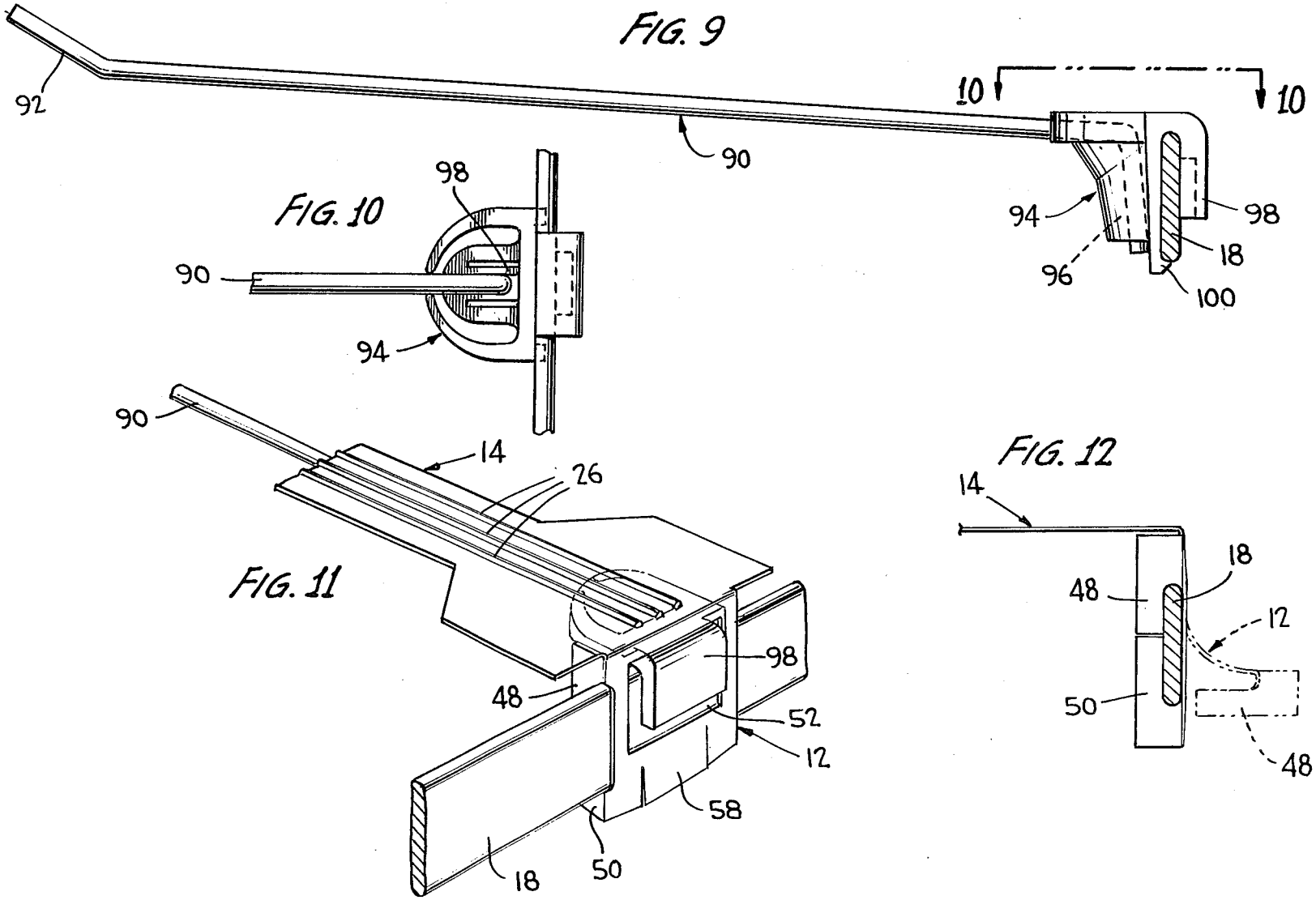
FIG. 9 is a side elevational view of a third form of flat bar-support product information display hook with which the tag maybe used.
FIG. 10 is a view on line 10—10 of FIG. 9.
FIG. 11 is a view similar to FIGS. 4 and 8 showing the third form of hook.
FIG. 12 is a part elevational view of the tag and flat bar showing how the mounting portion of the tag may be flexed into engagement with the bar.

FIGS. 9 through 11 show a third form of elongate product display hook 90 again having an upturned distal end 92 but in this case the hook has a plastic mounting bracket 94 at its distal end. In this structure, hook 90 may have a down turned proximal end section 96 for example which is force fitted into a receiving socket 98 of the bracket 94. Bracket 94 is formed with a prong structure 98 to fit over the top of bar 18 and a lower retaining lip 100, whereby bracket 94 is frictionally retained on the bar 18. It will be evident that the tag 10 may again be attached to the bar-hook combination shown in FIGS. 9 and 10 in similar manner to the previously described embodiments with cutout 52 again being sized to receive prong 98 of the hook mounting bracket.

It is evident from the foregoing that the invention provides a tag structure which is adapted to be attached to a hook-bar combination wherein the hook may have any one of a variety of mounting brackets and the tag may be conveniently secured thereto irrespective of the particular mounting bracket provided on the hook.

While only preferred embodiments of the invention have been described herein in detail, the invention is not limited thereby and modifications can be made within the scope of the attached claims.

While the tag of the instant invention is primarily designed for use on a bar-supported elongate product display hook, the tag is self supporting on the bar due to its nature and does not require the hook for support. Thus it can be used in the absence of a hook to display information at its distil end in space relation to the bar.

What is claimed is:

1. A sheet material product information display tag structure for use on a bar, the tag structure comprising a proximal end mounting portion for securing same to the bar and an elongate portion adjacent the mounting portion for extending forwardly from the bar to present product information at a distal end of the elongate portion, the mounting portion being connected to the elongate portion by a transverse fold line for bending the mounting portion down behind the bar substantially at right angles to the elongate portion, the mounting portion further including forwardly foldable edge portions each defining an upper flexible finger and a lower flexible finger for flexing over and under the bar respectively from behind so as to secure the tag to the bar, the mounting portion still further including elongate bar-receiving cutouts adjacent said fingers.

2. The invention of claim 1 wherein the tag structure includes transverse slits extending from opposite longitudinal edges of the tag structure to opposite ends of the transverse bend line respectively, the transverse slits defining the width of said fold-in edge portions.

3. The invention of claim 2 wherein the mounting portion still further includes lengthwise fold lines extending respectively from the opposite ends of the transverse bend line to a terminal edge of the mounting portion for defining the fold-in sections, each of the longitudinal fold lines being interrupted by a respective one of said elongate cutouts.

4. The invention of claim 1 wherein the mounting portion still further includes transverse slits extending from opposite longitudinal edges thereof into the respective elongate cutouts substantially at a mid-point of the length of the cutout and separating the respective upper and lower fingers.

5. The invention of claim 1 wherein the tag further includes an integral fold down display portion at a distal end of the intermediate portion.

6. The invention of claim 5 wherein the tag further includes a mounting means for a separate display element at a distal end of the intermediate portion.

7. The invention of claim 1 wherein the elongate portion of the tag includes an elongate reduced-width central section and lengthwise reinforcing ribbing.

8. The invention of claim 1 wherein the mounting portion further includes a central cut-out for receiving an upper bar-embracing prong element of a bracket at a proximal end of an elongate product display hook which bracket is adapted for securing the hook to the bar.

9. The invention of claim 8 wherein the mounting portion further includes a pair of slits extending inwardly from a terminal edge thereof to define a flap therebetween adapted to flex outwardly for accommodating a lower bar-embracing prong element of the bracket.

10. In combination with a bar-supported elongate product display hook having a proximal end bracket attaching the hook to the bar, the bracket having at least an upper bar-embracing prong element; a product information display tag of sheet material for providing product information at a distal end of the hook, the tag comprising a proximal end mounting portion securing the tag to the bar over said bracket and an elongate portion extending from the mounting portion over the hook for displaying the product information at a distal end thereof, the mounting portion being folded down from the elongate portion substantially at right angles behind the bar, the mounting portion having forwardly folded edge sections each defining an upper flexible finger and a lower flexible finger which are flexed over and under the bar respectively from behind whereby the tag is secured to the bar, the mounting portion still further including elongate bar-receding cutouts adjacent the fingers, and a central cutout receiving said prong element.

11. The invention of claim 10 wherein the bracket further includes a lower bar-embracing prong element and the mounting portion of the tag includes means defining a flap flexed rearwardly by said lower prong element for accommodating same.

12. The invention of claim 10 wherein said bracket is a metal bracket attached to a proximal end of the bar by welding or the like.

13. The invention of claim 10 wherein said bracket is a plastic bracket having a socket which receives a downwardly bent proximal end section of the hook for attaching the hook to the bracket.

* * * * *